United States Patent [19]

Shade, Jr.

[11] Patent Number: 4,540,164

[45] Date of Patent: Sep. 10, 1985

[54] WORKPIECE HOLDER

[76] Inventor: Edwin J. Shade, Jr., Lyons Station, Pa. 19536

[21] Appl. No.: 495,081

[22] Filed: May 17, 1983

[51] Int. Cl.[3] ..... B25B 1/00

[52] U.S. Cl. ..... 269/88; 269/93; 269/238; 269/287; 269/900; 269/902

[58] Field of Search ..... 33/174 TC, 174 S, 174 H, 33/173; 269/900, 902, 289 MR, 91, 93, 237, 238, 287, 9, 88, 156; 51/216 R, 216 A, 216 H, 217 A, 220, 221 R

[56] References Cited

U.S. PATENT DOCUMENTS

| | | | |
|---|---|---|---|
| 27,592 | 3/1860 | Cooper | 269/93 |
| 2,201,454 | 5/1940 | Reich | 33/174 H |
| 2,422,773 | 6/1947 | Colwill | 269/156 |
| 3,385,592 | 5/1968 | Hasell et al. | 269/156 |
| 3,824,744 | 7/1974 | Petrant | 269/902 |
| 3,967,816 | 7/1976 | Ramsperger et al. | 269/900 |
| 4,415,304 | 11/1983 | Tripoli et al. | 269/289 MR |

*Primary Examiner*—Robert C. Watson
*Attorney, Agent, or Firm*—Harvey B. Jacobson

[57] ABSTRACT

A multipurpose workpiece holding apparatus comprises a pair of plates which can be connected together to form an angle block suitable for squaring workpieces. Alternative workpiece hold-down devices may be attached to the respective plates, and one of the plates may be bored to receive and hold different diameter workpieces for sharpening and like purposes. The various components of the apparatus may be combined in different ways to provide different forms of holder.

10 Claims, 5 Drawing Figures

WORKPIECE HOLDER

BACKGROUND OF THE INVENTION

This invention relates to apparatus for use in machine shops and the like for holding workpieces while performing machining or other operations thereon.

In tool and die shops, for example, it is necessary to perform numerous different machining operations, such as drilling, grinding, sharpening, cutting and the like on various workpieces, which may be in different sizes and may be of different forms such as round stock, or stock of flat, square or other configuration. It is generally necessary properly and accurately to support a workpiece while one or other such operation is being performed, and workpiece holders are used for such purposes.

The present invention seeks to provide workpiece holding apparatus which is adaptable for holding or positioning diverse forms and sizes of workpieces in varying positions suitable for performing different operations thereon, thereby economizing on the amount of equipment required for workpiece holding purposes in workshops and the like.

DESCRIPTION OF THE PRIOR ART

Applicant is aware of the following U.S. patents relating to workpiece holders and the like:

U.S. Pat. No. 1,071,289—Aug. 28, 1915
U.S. Pat. No. 1,845,438—Feb. 16, 1932
U.S. Pat. No. 2,107,051—Feb. 1, 1938
U.S. Pat. No. 2,945,523—July 19, 1960
U.S. Pat. No. 4,339,116—July 13, 1982

SUMMARY OF THE INVENTION

The invention provides workpiece holding apparatus which comprises plural components that may be used singly, or may be connected together in differing combinations, to form holding or positioning devices suitable for various purposes.

For example, the apparatus may include a pair of generally rectangular steel plates, and means for connecting the plates together to form an angle block to which stock may be clamped, for example, for squaring the sides or ends, with or without an end plate attachment which may be secured to one end of the angle block.

Further, at least one of the plates may be provided with a series of through-bores of varying diameter, for receiving different sizes of round stock workpieces. Threaded holes may lead into the respective bores for receiving set screws whereby a workpiece may be fixedly clamped in a respective bore for machining opposite ends thereof.

Additionally, alternative hold-down means may be provided for attachment to the respective plates, for use with V-shaped grooves formed in the plates, to hold round stock such as punches and the like. One hold-down attachment may, for example, comprise a roller arrangement allowing for rotation of the workpiece being held, with a crank and handle being provided for rotating the workpiece. This attachment may be used, for example, in grinding one end of a workpiece to a smaller diameter. Another hold-down attachment may, for example, comprise a vise-like jaw for holding a workpiece such as a punch, in a fixed vertically oriented position for sharpening one end thereof.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 4:
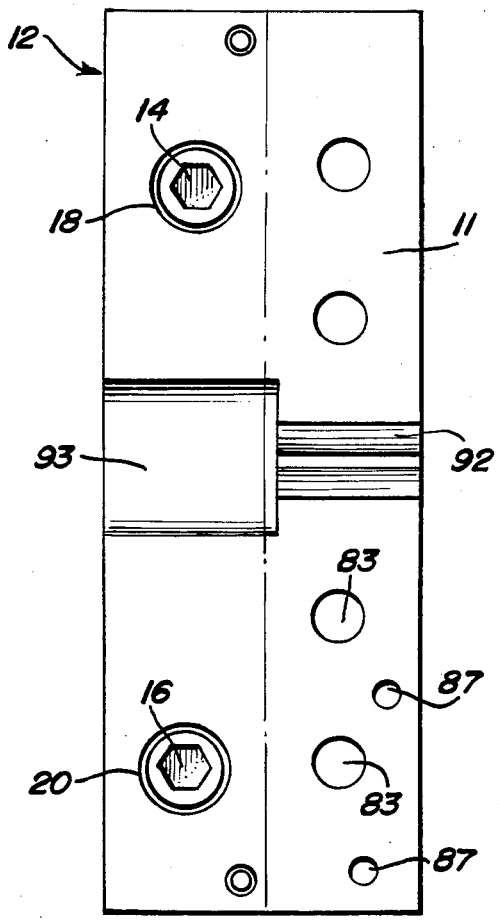
FIG. 4 is an underneath view of one component of the apparatus.
Figure 5:
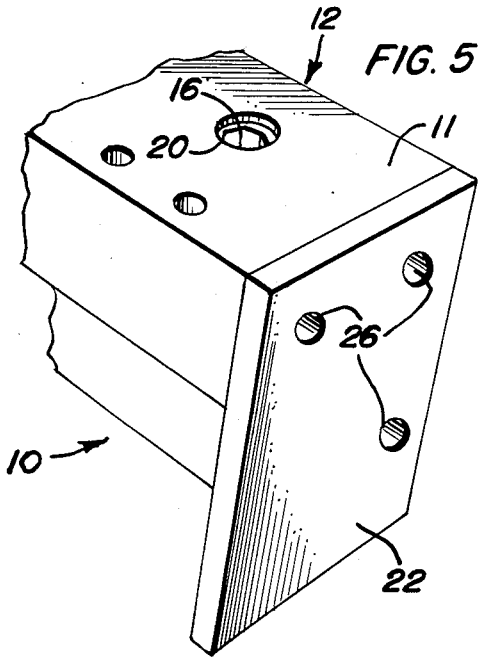
FIG. 5 is a perspective view of one end of the apparatus showing an end plate attachment used when the apparatus is employed for squaring purposes.

The basic components of the illustrated workpiece holding apparatus comprise a pair of generally rectangular-shaped steel plates 10 and 12, which may be connected together to form an angle block as shown in the drawings, by means of Allen screws 14 and 16 (FIG. 4) which fit in openings 18 and 20 formed through plate 12 and aligned tapped bores (not shown) formed in plate 10 from one side thereof. The basic angle block assembly may be used per se, for example, for the clamping of workpieces thereto for squaring purposes and the like. Further, an end plate attachment 22 (FIG. 5) is provided which, by means of openings 26 in the plate, aligned openings 24, 38 in the angle block, and suitable set screws (not shown) may be attached to one end of the block assembly, in which configuration the apparatus may, for example, be used for clamping workpieces thereto for squaring the ends or sides thereof.

Figure 1:
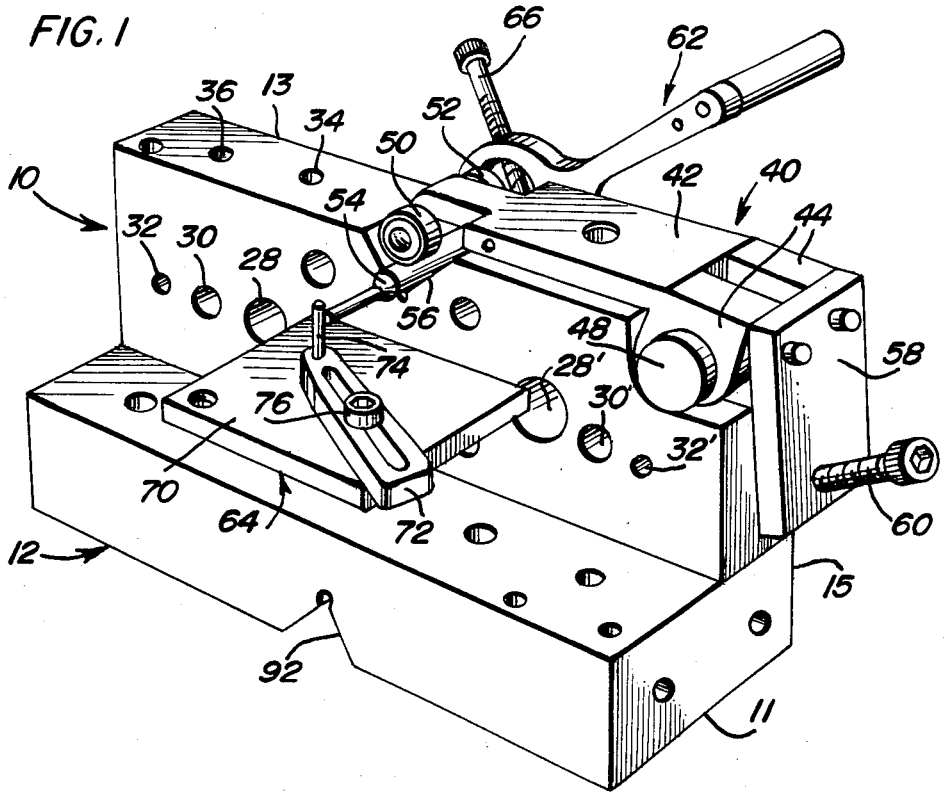
FIG. 1 is a perspective view of workpiece holding apparatus in accordance with the invention, assembled to provide a first hold-down means.
Figure 2:
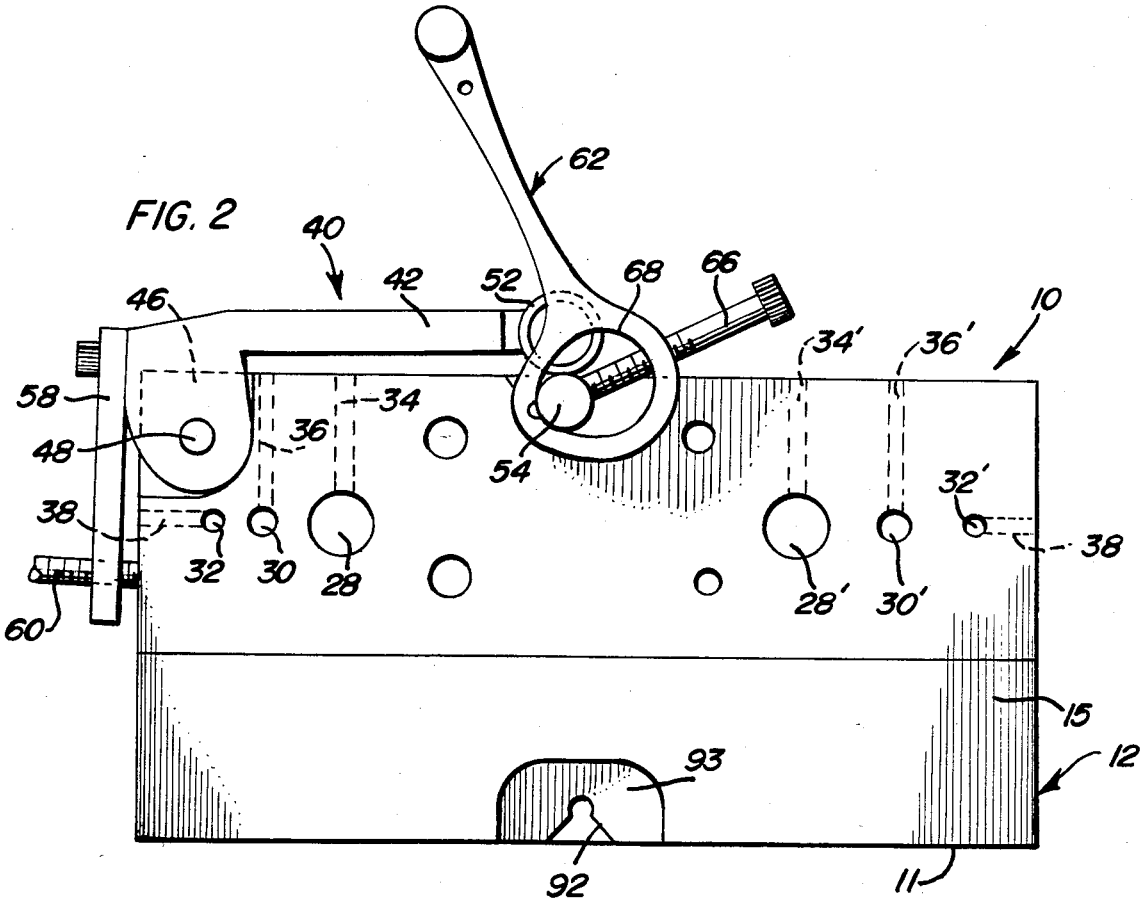
FIG. 2 is rear elevational view of the apparatus assembled as in FIG. 1.

As seen more particularly in FIGS. 1 and 2, plate 10 has a series of through-bores 28, 30, 32 and 28', 30', 32' each of different diameter, for receiving round-bar stock, for example, of the appropriate diameter. Further, a series of tapped holes 34, 36, 38 and 34', 36', 38' are located in positions intersecting the respective through-bores for receipt of set screws (not shown) which may be used fixedly to clamp round stock workpieces in the respective through-bore. This arrangement may, for example, be used to hold different sized punches or the like where grinding or key-forming to the same length is required at opposite projecting ends of the workpieces. This may best be acomplished by separating plate 12 from plate 10. The through-bores used in conjunction with the set screws insure that punches will remain fixed and centrally located and the through through-bores give a true grinding parallel with each other for a cutting edge and head for keying a punch.

FIGS. 1 and 2 show a first hold-down device 40 attached to the basic angle block structure. The hold-down device comprises a pivotal arm 42 having bifurcated limbs 44 by which it is pivotally mounted to a web 46 formed at one corner of plate 12, by means of a removable pivot pin 48 and aligned openings in the limbs and web. At its free end, arm 42 carries a pair of rollers 50, 52 which, in use, ride against a workpiece, such as a punch 54 which may be supported in a V-shaped groove 56 formed in one side of plate 10, and appropriately positioned in relation to web 46 so that it aligns with the rollers. Adjacent its pivoted end, arm 42 carries a depending plate 58 with an adjustment screw 60, which can be adjusted to bear against the side of plate 10 so as to tighten the rollers 50, 52 down onto the punch and accommodate different punch diameters.

Hold-down device 40 may be used in conjunction with a crank-handle member 62 and an adjustable stop assembly 64 (FIG. 1). Crank-handle member 62 has an opening 68 at one end, and a set screw 66 associated therewith, whereby the crank-handle member may be secured to the head of punch 54 to allow for manual rotation of the punch. Stop assembly 64 comprises a plate 70 which may have a depending flange (not shown) whereby it may be releasably secured against a side face of plate 10 by appropriate screws or the like. A slide 72 with a stop pin 74 may be carried on plate 70 and may be tightened down by an Allen screw 76. The slide may be used to adjust the position of pin 74 so that it may restrain lengthwise movement of punches of differing diameters and differing lengths. The hold-down device 40 in conjunction with crank-handle member 62 and stop assembly 64 may be used, for example, for grinding down punch ends to a reduced diameter where rotation of the punch, without lengthwise movement thereof, is required.

Figure 3:
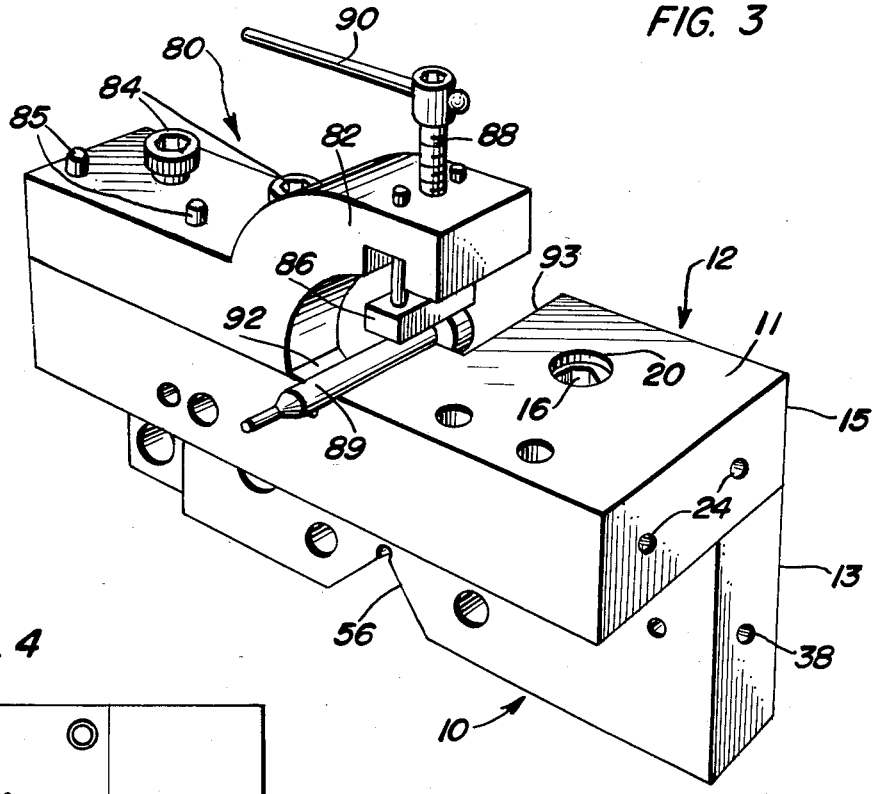
FIG. 3 is a perspective view of the apparatus assembled to provide a second form of hold-down means.

FIG. 3 shows an alternative hold-down device 80 attached to the basic angle block assembly in place of device 40. It will be noted that device 80 attaches to face 11 of plate 12 (face 11 being the underneath face in FIGS. 1 and 2). Device 80 includes a support arm 82 releasably attached to plate 10 by means of Allen screws 84 which thread into openings 83 in plate 12 (see FIG. 4). Alignment pins 85 are provided on arm 82 which fit in openings 87 in plate 12. Arm 82 carries a vise-like jaw 86 controlled by a screw 88 and handle 90, jaw 86 being used to clamp around stock of varying sizes such as illustrated punch 89 in a V-shaped groove 92 formed at an appropriate position in face 11 of plate 12. The groove has a communicating well 93 for receiving the head of punch 89. Hold-down device 80 may, for example, be used for clamping round stock in a vertical position (with the angle block resting on face 13 of plate 10 and face 15 of plate 12), for sharpening or other purposes.

It will be seen from the foregoing that the invention provides workpiece holding apparatus comprising plural components which may be used in various combinations, either in assembled or unassembled form, to provide holding and positioning devices suitable for use in performing diverse operations on workpieces commonly needed in general workshop practice.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A workpiece holder comprising a plate formed with a depression in one edge theeof for receiving an elongate workpiece in a manner providing rotation of the workpiece about its longitudinal axis, and hold-down means for the workpiece including a lever provided with a roller means, means for pivotally mounting the lever on the plate with the roller means engaging the workpiece, and an adjustment screw for connection between the lever and the plate to provide pivotal movement of the lever for tightening the roller means against the workpiece, wherein the lever has a first arm provided with said roller means and a second arm angled with respect to the first arm, the means for pivotally mounting the lever being situated at a corner of the plate so that the second arm of the lever extends along another edge of the plate adjacent said one edge, and the adjustment screw being operable between the second arm of the lever and said another edge of the plate.

2. The invention of claim 1 including a crank having a crank handle at one end and means at the other end for attaching the crank to the workpiece comprising an opening for receiving the workpiece and a screw for tightening onto the workpiece.

3. The invention of claim 1 including an adjustable stop assembly and means for attaching the stop assembly to a surface of the plate adjacent said one edge in position for the stop assembly to provide lengthwise location of the workpiece.

4. The invention of claim 3 wherein the stop assembly comprises a mounting bracket and a slotted bar with a stop member, the bar being adjustably secured on the mounting bracket.

5. The invention of claim 3 including a further plate for attachment to the opposite edge of the original plate to form an elongate angle block suitable as a guide for squaring workpieces, and a second hold-down means for attachment to an exposed surface of the other plate, said surface including a groove for receiving a further workpiece, the second hold-down means including an adjustable jaw member for forming a vise in conjunction with said groove.

6. A multi-purpose workpiece holder comprising first and second generally rectangular plates, means for releasably attaching the plates together to form an elongate angle block suitable as a guide for squaring workpieces with one edge of one of the plates engaging one surface of the other plate, a notch in the opposite edge of the one plate for rotatably receiving a workpiece, a first hold-down device for attachment to the one plate for rotatably holding the workpiece in the notch, the first hold-down device comprising a lever provided with roller means, means for pivotally securing the lever on said one plate for engagement of the roller means against the workpiece, and an adjustment screw for connection between the lever and the one plate to provide pivotal movement of the lever for tightening the roller means against the workpiece, a groove formed in the opposite surface of the other plate for receipt of another workpiece, and a second hold-down means for attachment to said opposite surface of the other plate for holding said another workpiece in the groove, the second hold-down means including an adjustable jaw member for forming a vise in conjunction with said groove.

7. The invention of claim 6 wherein said lever has a first arm provided with said roller means, and a second arm angled with respect to the first arm, the means for pivotally mounting the lever being situated at a corner of the one plate so that the second arm of the lever extends along another edge of the plate adjacent said opposite edge of the one plate, and the adjustment screw being operable between the second arm of the lever and said another edge of the plate.

8. The invention of claim 7 including an adjustable stop assembly, and means for attaching the stop assembly to a surface of said another plate adjacent said opposite edge in position for the stop assembly to provide lengthwise location of the workpiece.

9. The invention of claim 7 wherein one of said plates is formed with a plurality of through bores of different diameters respectively for receiving elongate workpieces of different diameters, and tapped holes formed from edges of the plate intersecting the through bores to receiving clamping screws for clamping workpieces in the respective through bores.

10. The invention of claim 6 wherein the opposite surface of the other plate has an enlarged well communicating with the groove for receiving an enlarged head of a workpiece received in the groove.

* * * * *